US006334511B1

(12) United States Patent
Araki

(10) Patent No.: US 6,334,511 B1
(45) Date of Patent: Jan. 1, 2002

(54) DOUBLE-DECK ELEVATOR CONTROL SYSTEM

(75) Inventor: Hiroshi Araki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/624,624

(22) Filed: Jul. 25, 2000

(30) Foreign Application Priority Data

Dec. 20, 1999 (JP) ..... 11-360913

(51) Int. Cl.[7] ..... B66B 1/00
(52) U.S. Cl. ..... 187/380; 187/902
(58) Field of Search ..... 187/277, 391, 187/393, 394, 902

(56) References Cited

U.S. PATENT DOCUMENTS

| | | | | |
|---|---|---|---|---|
| 4,337,847 A | * | 7/1982 | Schroeder et al. | 187/29 R |
| 4,354,577 A | | 10/1982 | Yonemoto | |
| 5,220,981 A | * | 6/1993 | Kahkipuro et al. | 187/16 |
| 5,861,587 A | * | 1/1999 | Powell et al. | 187/382 |
| 5,907,136 A | * | 5/1999 | Hongo et al. | 187/277 |
| 6,161,652 A | * | 12/2000 | Kostka et al. | 187/291 |
| 6,176,351 B1 | * | 1/2001 | Ikeda et al. | 187/387 |

FOREIGN PATENT DOCUMENTS

| | | |
|---|---|---|
| JP | 4-303378 | 10/1992 |
| JP | 10-36015 | 2/1998 |
| JP | 10-279231 | 10/1998 |

* cited by examiner

*Primary Examiner*—Jonathan Salata
(74) *Attorney, Agent, or Firm*—Leydig, Voit & Mayer, Ltd.

(57) ABSTRACT

A double-deck elevator control system for running two elevator cars in a car frame, such that the two elevator cars travel at the same acceleration and deceleration, and stopping the elevator cars according to a floor-to-floor distance without deteriorating riding comfort. The double-deck elevator control system includes a car frame retaining two elevator cars such that at least one of the two elevator cars may be vertically moved with respect to the frame; a first control unit for controlling movement of the car frame; an actuator for vertically moving at least one of the two elevator cars with respect to the car frame; a second control unit for controlling the actuator; and a remaining travel distance computing unit for computing remaining distances from current positions of the car frame and the elevator cars to planned stopping positions, wherein the first control unit controls a movement of the car frame based on a remaining travel distance of the car frame and the second control unit controls the actuator based on a difference between the remaining travel distances of the car frame and of each elevator car.

11 Claims, 10 Drawing Sheets

DOUBLE-DECK ELEVATOR CONTROL SYSTEM

BACKGROUND OF THE INVENTION

1. Field of the Invention

The present invention relates to an elevator in which a plurality of cars are installed on a car frame.

2. Description of Related Art

In recent years, buildings are increasingly becoming higher, and there has been a demand for mass transport by elevators.

In order to enhance carrying capacities by using regular elevators, it is required to increase dimensions of cars and hoistways. This is difficult, however, because effective use of limited spaces in buildings is required, and there are many restrictions, such as soaring land prices.

To overcome such difficulties, there has been proposed a double-deck elevator having a two-story car. In this double-deck elevator, two cars are vertically arranged in one hoistway so as to land the two cars on two floors at the same time to substantially double carrying capacity of the elevator per hoistway.

FIGS. 8, 9, and 10 show a construction and an operation of a conventional double-deck elevator control system disclosed in Japanese Unexamined Patent Publication No. 4-72288.

Referring to FIG. 8, in the conventional double-deck elevator, an upper car and a lower car respectively having independent functions are installed on an integral car frame 1.

The upper car 8 is installed via a vibration-proof rubber component 7 on a car holding beam 5 on a separating beam 3 of the car frame 1. Two hydraulic jacks 10 are located between a lower beam 4 and a car holding beam 6 provided on a top of the car, then a lower car 9 is disposed on the car holding beam 6 via another vibration-proof rubber component 7.

Guiding devices 11 engaging upright beam 2 are installed on both sides of the top of the lower car 9. A shock absorber 12 is provided between a ceiling of the lower car and a bottom surface of the separating beam 3.

A potentiometer 13 is provided on a plunger side of the hydraulic jack to measure an operating stroke of the plunger (relative position of the lower car 9 with respect to the car frame 1).

A car interval adjuster 15 is connected to an elevator operation controller 14. Distances between individual floors of a building are read and stored beforehand, as data, in a microcomputer of the car interval adjuster 15.

To land at a floor in response to a call in a building that does not have uniform intervals between floors, a jack operation pattern for adjusting a distance between the upper and lower cars to a distance between floors before the cars are landed is set. The jack operation pattern is based on data regarding a distance between landing floors that has been stored in a memory of the microcomputer of the car interval adjuster 15.

Based on the foregoing set pattern, a hydraulic jack actuation command is issued from a microcomputer to actuate the hydraulic jacks 10. This causes the lower car 9 to engage the upright beam 2 by the guiding devices 11 so as to move up or down, thereby changing the distance between the upper and lower cars. The change in the distance is checked by the potentiometer 13 to make an adjustment so as to accomplish agreement with the distance between the landing floors.

Since the conventional double-deck elevator operation control system is configured as set forth above, when the elevator lands in response to a call from a landing elevator hall, the elevator begins decelerating upon response to the call from the landing elevator hall in a quickest case. Therefore, the adjustment for making the distance between the cars coincide with the distance between the landing floors must be completed in a short time, from the moment the deceleration is started to the landing. Hence, the deceleration speed greatly varies according to the amount of movement required for adjusting the distance between the cars and the time required for completing the movement, presenting a problem of deteriorated riding comfort.

SUMMARY OF THE INVENTION

The present invention has been made with a view toward solving the problem described above, and it is an object of the invention to provide a double-deck elevator control system capable of running a double-deck elevator installed in a building having different distances between some floors, and which has a car frame retaining two cars such that at least one of the two cars may be vertically moved relative to the other in such a manner that the cars travel at the same acceleration or deceleration and stop according to a distance between the floors.

To this end, according to one aspect of the present invention, there is provided a double-deck elevator control system comprising: a car frame for retaining two cars such that at least one of the two cars may be vertically moved; a first control unit for controlling a movement of the car frame; an actuator for vertically moving at least one of the two cars with respect to the car frame; a second control unit for controlling the actuator; and a remaining travel distance computing unit for computing a remaining distance from a current position of each of the car frame and the cars to a planned stopping position, wherein the first control unit controls a movement of the car frame based on a remaining travel distance of the car frame, while the second control unit controls the actuator based on a difference between the remaining travel distance of the car frame and a remaining travel distance of each car.

In a preferred form of the present invention, the double-deck elevator control system may be further provided with a detector for detecting a relative position of each car with respect to the car frame, and the remaining travel distance of each car may be calculated based on the relative position of each car with respect to the car frame.

According to another aspect of the present invention, there is provided a double-deck elevator control system comprising: a car frame for retaining two cars such that at least one of the two cars may be vertically moved; a first control unit for controlling a movement of the car frame; an actuator for vertically moving at least one of the two cars with respect to the car frame; a second control unit for controlling the actuator; a remaining travel distance computing unit for computing a remaining distance from a current position of each of the car frame and the cars to a planned stopping position; and a speed command generating unit for generating a speed command value based on the travel distance of the car frame and outputting the speed command value to the first control unit and for generating a speed command value based on a remaining travel distance of each car and outputting the speed command value to the second control unit, wherein the first control unit controls the movement of the car frame based on the speed command value of the car frame, while the second control unit controls the actuator based on a difference between the speed command value of the car frame and a speed command value of each car.

In a preferred form of the double-deck elevator control system in accordance with the present invention, the actuator may be constituted by two lifting units for vertically moving the two cars independently.

In another preferred form, one of the two cars is secured to the car frame, and only the other car is vertically moved by the actuator.

In yet another preferred form, the actuator vertically moves the two cars at an equal interval in opposite directions.

In a further preferred form, the actuator has a pantograph mechanism.

In a further preferred form, the actuator has a suspension type elevator mechanism.

In a further preferred form, while the car frame and an upper and lower car are decelerating, the speed command value for the car frame is calculated as a mean value of a speed command value for the lower car and a speed command value for the upper car.

DESCRIPTION OF THE PREFERRED EMBODIMENTS

First Embodiment

Figure 1:
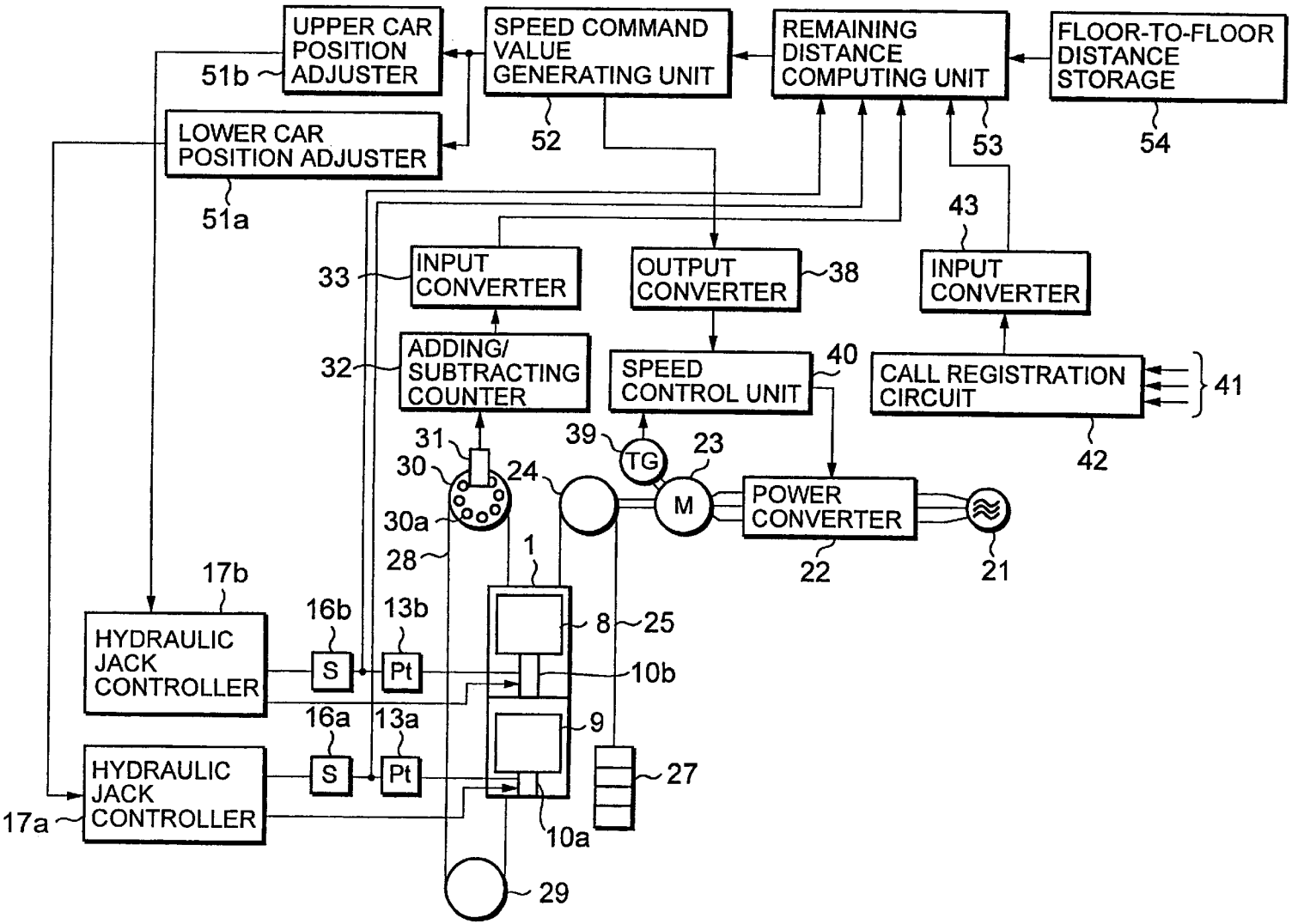
FIG. 1 is a block diagram showing a construction of an elevator control system according to an embodiment of the present invention.
Figure 2A:
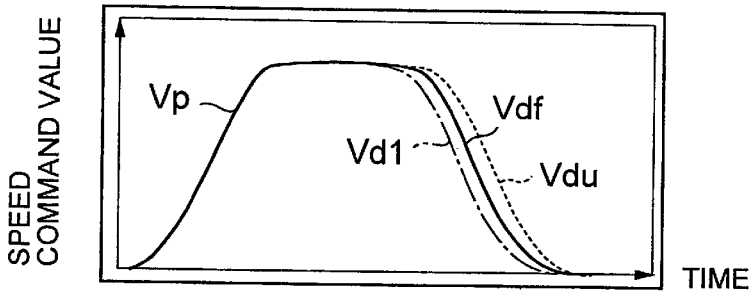
FIGS. 2(*a*), 2(*b*), 2(*c*), and 2(*d*) show speed command value and acceleration curve charts for a first embodiment of the present invention.
Figure 2B:
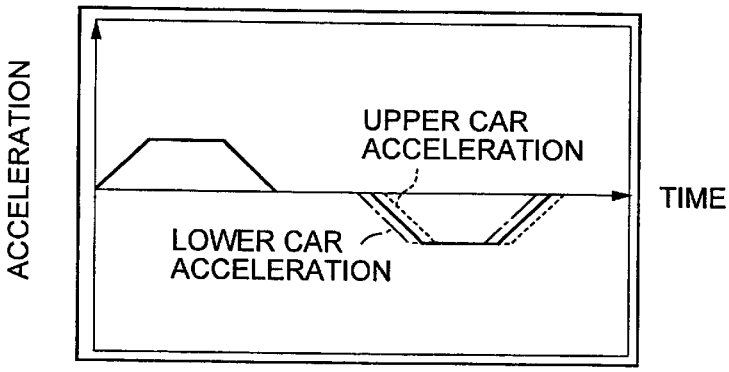
Figure 2C:
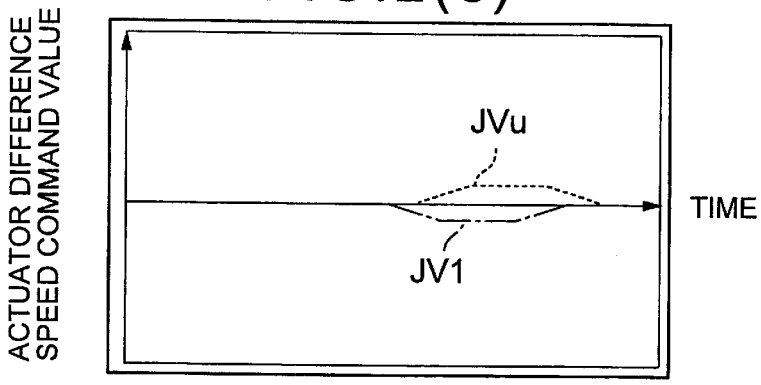
Figure 2D:
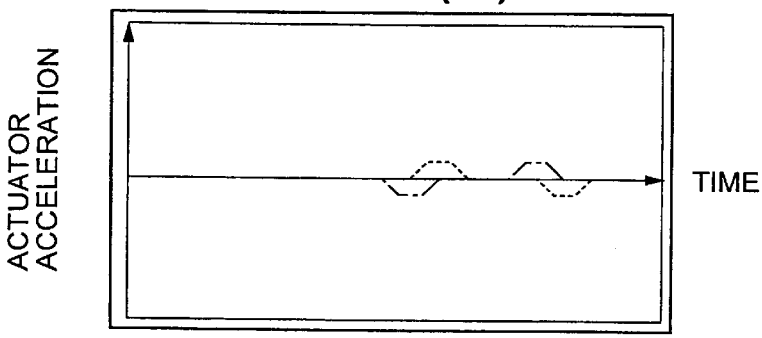
Figure 3:
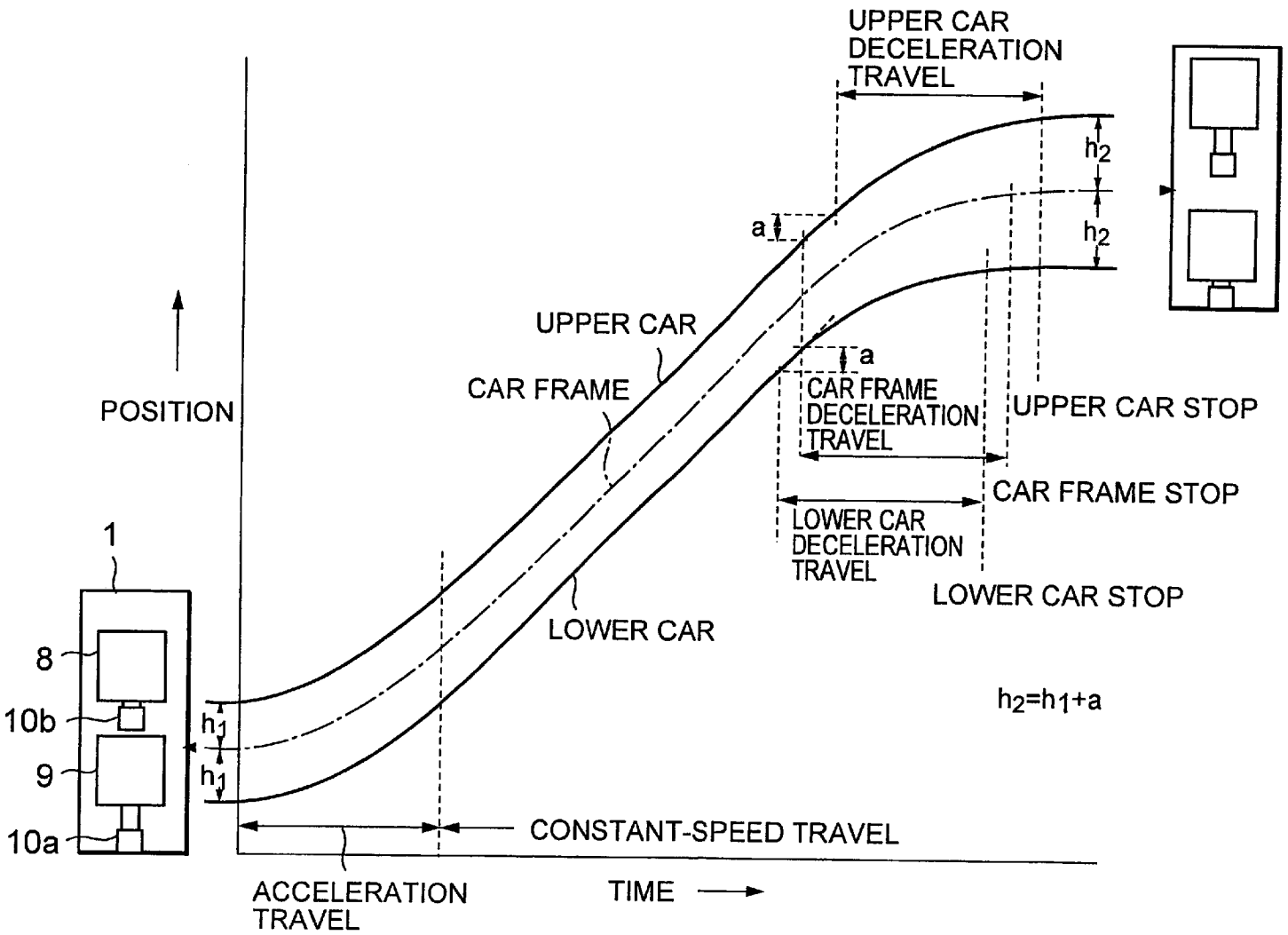
FIG. 3 is a schematic travel chart of a car frame and upper and lower cars for the first embodiment of the present invention.
Figure 4A:
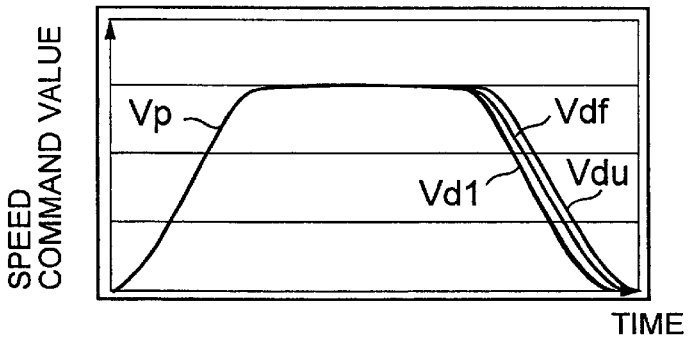
FIGS. 4(*a*), 4(*b*), 4(*c*), and 4(*d*) show speed command value and acceleration curve charts for a second embodiment of the present invention.
Figure 4B:
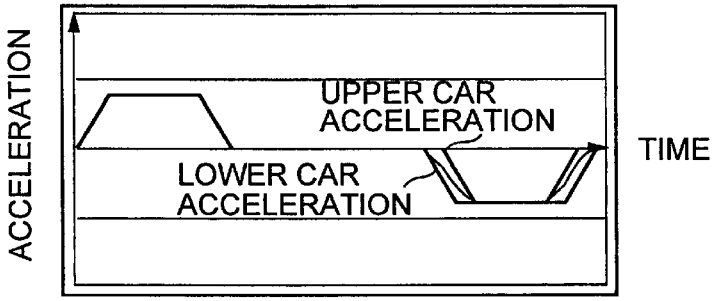
Figure 4C:
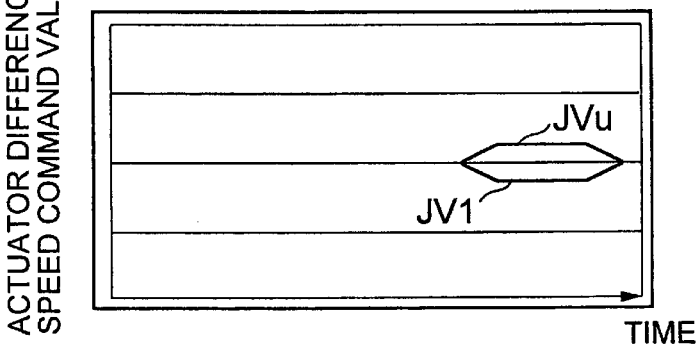
Figure 4D:
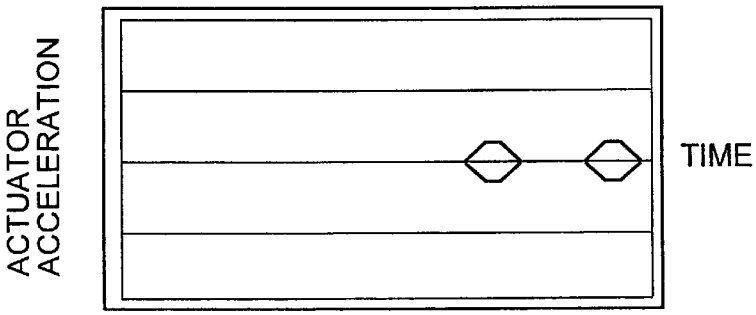

The following will describe a first embodiment of the present invention with reference to FIGS. 1 through 3.

Referring to FIG. 1, a double-deck elevator control system has: a hydraulic jack 10*a* for vertically moving a lower car 9 relative to a car frame 1; a hydraulic jack 10*b* for vertically moving an upper car 8 relative to the car frame 1; a potentiometer 13*a* for detecting a current position of the hydraulic jack 10*a* for the lower car 9 from the car frame 1; a potentiometer 13*b* for detecting a current position of the hydraulic jack 10*b* for the upper car 8 from the car frame 1; a differentiator 16*a* for converting a signal of the potentiometer 13*a* into speed; a differentiator 16*b* for converting a signal of the potentiometer 13*b* into a speed; a control unit 17*a* for the hydraulic jack 10*a* for the lower car 9; and a control unit 17*b* for the hydraulic jack 10*b* for the upper car 8.

The double-deck elevator control system further includes: a power supply 21; a power converter 22 for driving a motor; a hoisting motor 23 connected to the power converter 22; a sheave 24 of a hoisting machine driven by the motor 23; a main rope 25 wound on the sheave 24 and connected to the car frame 1 and the counterweight 27; an endless rope 28 having its both ends linked to the car frame 1; a disc 30 that is installed in an elevator machine room, has the rope 28 wound thereon, and has small holes 30*a* formed at equal intervals in its circumferential portion; a pulse generator 31 for generating a pulse each time the small hole 30*a* is detected; an adding/subtracting counter 32 for adding the pulse when the car frame 1 ascends, while it subtracts the pulse when the car frame 1 descends thereby to count a current position of the car frame 1; an input converter 33 for converting an output of the counter 32 into information for a microcomputer; and a speed encoder 39 for detecting a rotational speed of the motor 23.

The double-deck elevator control system is further includes: a lower car position adjuster 51*a* for issuing a hydraulic jack speed command value to the control unit 17*a* of the hydraulic jack for the lower car 9; and an upper car position adjuster 51*b* for issuing a hydraulic jack speed command value to the control unit 17*b* of the hydraulic jack for an upper car 8.

The double-deck elevator control system further includes: a speed command generating unit 52 for issuing speed commands to the car frame 1, the lower car 9, and the upper car 8; a remaining distance computing unit 53 for computing a travel distance required for each of the car frame 1, the lower car 9, and the upper car 8, respectively, to reach a planned landing floor; and a floor-to-floor distance storage 54 for storing a distance between floors.

FIGS. 2(*a*), 2(*b*), 2(*c*), and 2(*d*) show speed command value curve charts and acceleration curve charts for explaining an operation of the speed command value generating unit 52.

FIG. 3 is a travel schematic chart illustrating time-dependent positions of the car frame 1, the lower car 9, and the upper car 8.

An operation will now be described. When a start command is issued to the elevator, the speed command value generating unit 52 generates a speed command value Vp for acceleration that changes at a predetermined acceleration as time passes in accelerating the cars, as disclosed in, for example, Japanese Unexamined Patent Publication No. 57-9678.

When the motor 23 is driven, the car frame 1 starts to move via the sheave 24 and the main rope 25. The speed encoder 39 issues a speed signal based on a speed of the motor 23, that is, a speed of the car frame 1. The speed signal is checked against the foregoing speed command value Vp to perform automatic speed control, thereby accurately controlling the speed of the car frame 1.

Furthermore, an ascent and a descent of the car frame 1 are transmitted to the disc 30 via the rope 28, a pulse is generated from the pulse generator 31, and the pulse is subjected to addition or subtraction by the adding/subtracting counter 32, and the result is captured into the remaining distance computing unit 53 via the input converter 33.

The remaining distance computing unit 53 computes a travel distance required for each of the car frame 1, the lower car 9, and the upper car 8 to land planned floors, based on a floor-to-floor distance of respective floors stored in advance in the floor-to-floor distance storage 54.

In a similar procedure to that disclosed in the foregoing publication, the speed command value generating unit 52 generates a lower car speed command value Vdl, an upper car speed command value Vdu, and a car frame speed command value Vdf that decrease at a predetermined deceleration according to a remaining distance based on the positions of the cars.

Subsequently, the lower car position adjuster 51*a* calculates a difference between the lower car speed command value Vdl and the car frame speed command value Vdf. The upper car position adjuster 51*b* calculates a difference between the upper car speed command value Vdu and the car frame speed command value Vdf.

The lower car position adjuster 51*a* and the upper car position adjuster 51*b* output the speed command value differences JVl and JVu as the speed command values for the lower car 9 and the upper car 8 to the hydraulic jack control units 17*a* and 17*b*, respectively.

Based on the difference speed command values JVl and JVu of the lower car 9 and the upper car 8, the hydraulic jack control units 17*a* and 17*b* differentiate outputs of the potentiometers 13*a* and 13*b* by the differentiators 16*a* and 16*b* to obtain speed feedback values for the hydraulic jacks. Using the speed feedback values, the speeds of the lower car 9 and the upper car 8 to adjust the positions of the cars.

Referring now to FIG. 3, the movements of the car frame and the individual cars will be described. FIG. 3 shows a chart wherein an axis of abscissa indicates an elapse of time, while an axis of ordinates indicates the positions of the upper and lower cars and the car frame that correspond to an ascending or descending direction of the hoistway. The chart illustrates time-dependent positions of the upper and lower cars and the car frame until the entire car assembly stops, after ascending, at floors having a larger interval than a floor-to-floor interval of the upper and lower cars at a previous stop.

First, at the time of acceleration, the car assembly travels based on the foregoing speed command value Vp during a constant-speed travel. At this time, the actuators, such as the hydraulic jacks for moving the cars up or down with respect to the car frame, are not moved. The car frame 1, the lower car 9, and the upper car 8 ascend as one piece at the same speed pattern, meaning the same acceleration travel time.

The car assembly starts deceleration as it approaches the destination floors. If the interval between the destination floors increases as in the case of an example shown in FIG. 3, then the lower car 9 may apparently stop sooner only by "a", while the upper car 8 may apparently go too far only by "a" before it stops. More specifically, as shown in the chart, when it is assumed that the car frame 1 stops at a midpoint between the floor interval, if a floor-to-floor distance before a start is represented by 2*h1, then a floor-to-floor distance after a stop is represented as 2*h2 or 2*(h1+a). Thus, to determine deceleration start points by carrying out the computation of remaining distances, the remaining distances for stopping by deceleration from the same speed, i.e., the deceleration start points, are obtained by stopping the lower car 9 sooner by "a" with respect to a deceleration start point of the car frame and by stopping the upper car 8 after letting it overrun by "a" with respect to the deceleration start point of the car frame.

If another portion of the car frame 1 is established as a reference for a stopping position rather than always stopping the car frame 1 at the midpoint of the floor interval as shown in FIG. 3, then the deceleration start points of the upper car 8 and the lower car 9 will not have the same distance with respect to the deceleration start point of the car frame. The deceleration start points, however, do not necessarily have to be equally distanced; an adjustment can be made to accommodate the difference in distance.

When destination floors are determined, the positions at which the car frame 1, the lower car 9, and the upper car 8 should stop are taken out from the floor-to-floor distance storage 54, and the remaining distance computing unit 53 starts the calculation of remaining distances. The remaining distances are computed by entering a relationship between the position of the car frame 1 and the positions of the lower car 9 and the upper car 8 with respect to the car frame, namely, measurement values of the potentiometers 13*a* and 13*b*.

The speed command values for decelerating the car frame 1, the lower car 9, and the upper car 8 are determined by the aforesaid remaining distances. The car frame 1 is controlled in deceleration based on the speed command value Vdf.

The speed command values Vdl and Vdu for the lower car 9 and the upper car 8, respectively, obtained by the remaining distance computation are output; however, they differ from the speed command value Vdf for the car frame 1 in timing for starting the deceleration, producing differences from the speed of the car frame 1. Hence, the speed differences between the lower car 9 and the car frame 1 and between the upper car 8 and the car frame 1 are computed, and the lower car difference speed command value JVl and the upper car difference speed command value JVu are output. Based on the command values, the hydraulic jacks 10*a* and 10*b* operate to change the positions of the lower car 9 and the upper car 8. The position changing speeds of these cars are superimposed on the movement of the car frame, and a resulting movement provides the decelerations Vdl and Vdu instructed to the cars.

Thus, the lower car 9 and the upper car 8 stop at predetermined destination positions in a regular deceleration waveform identical to that of the car frame. This allows the double-deck elevator to move as if it were a single-car elevator. More specifically, the lower and upper cars are able to smoothly and accurately land at destination floors without causing passengers to feel uncomfortable acceleration or deceleration caused by a sudden deceleration or an uneven deceleration.

In the above descriptions, the actuators for vertically moving the lower car 9 and the upper car 8 with respect to the car frame 1 operate the cars independently. However, the same advantage can be obtained, for example, by securing one of the cars to the car frame and by vertically moving only the other car. This method simplifies driving mechanisms, such as actuators, and control mechanisms, providing advantages of a reduced weight and cost of an entire car assembly.

Second Embodiment

Referring to FIG. 4(*a*) through FIG. 7, a second embodiment of the present invention will be described.

Figure 6:
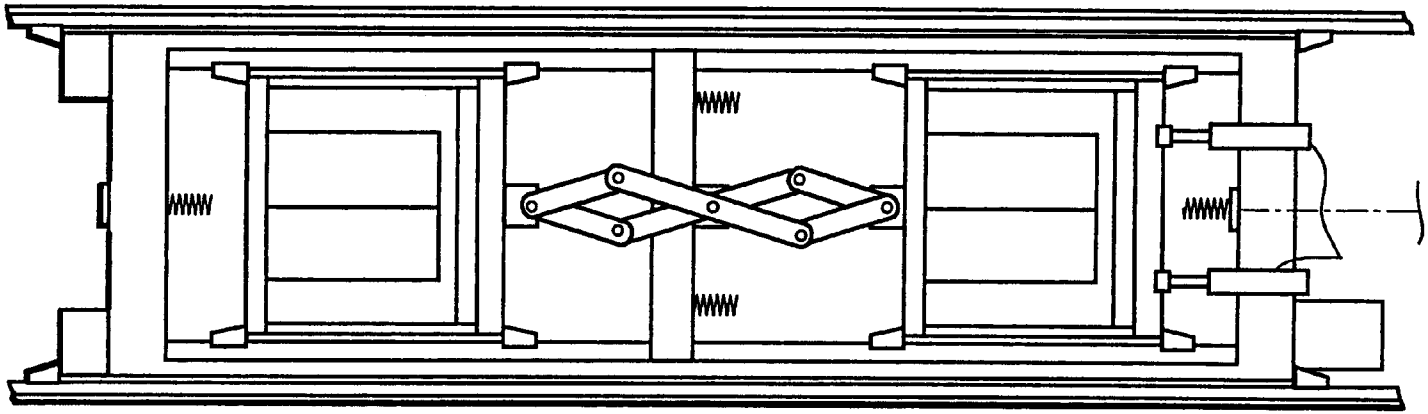
FIG. 6 is a elevational view of a double-deck elevator having an actuator with a pantograph type mechanism.

FIG. 6 is a elevational view showing a structure of a double-deck elevator in which a pantograph type link mechanism moves a lower car 9 and an upper car 8 at an equal interval in opposite directions.

Figure 7:
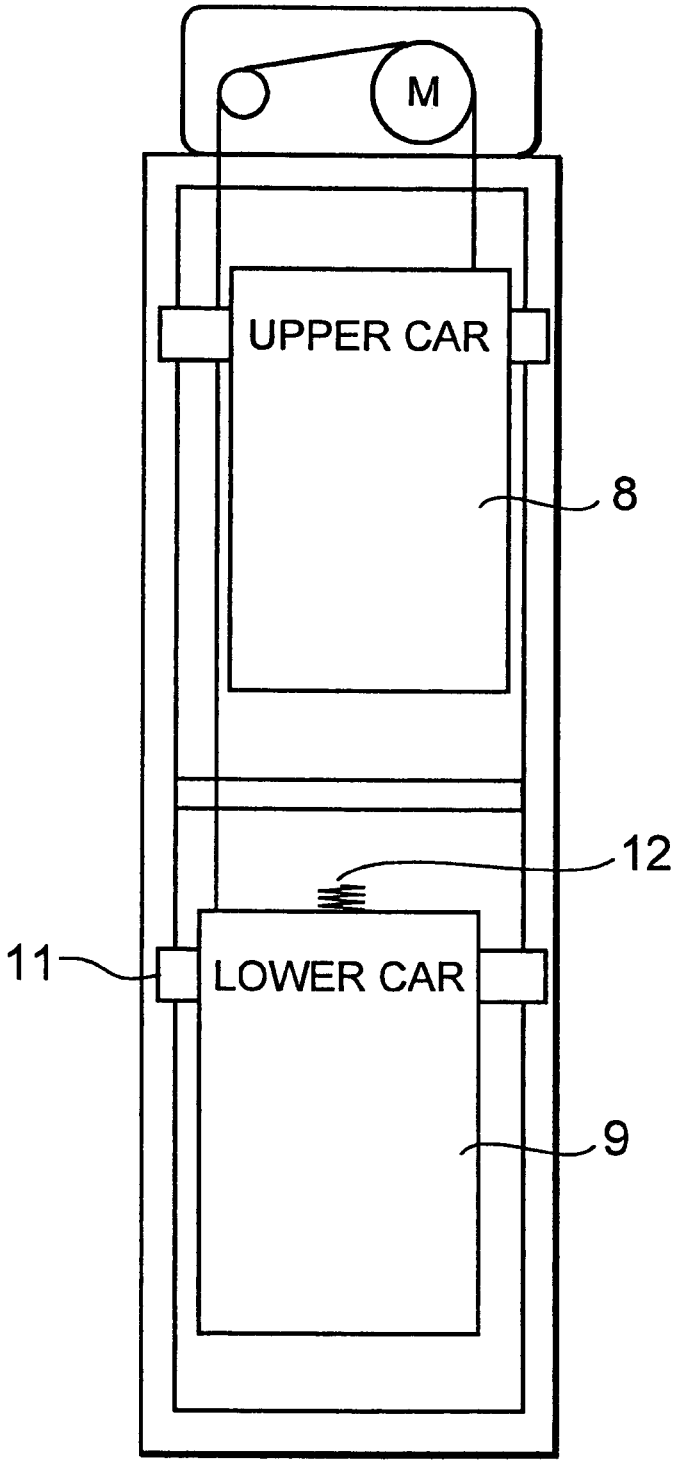
FIG. 7 is a elevational view of a double-deck elevator having an actuator with a suspension type elevator mechanism.
Figure 8:
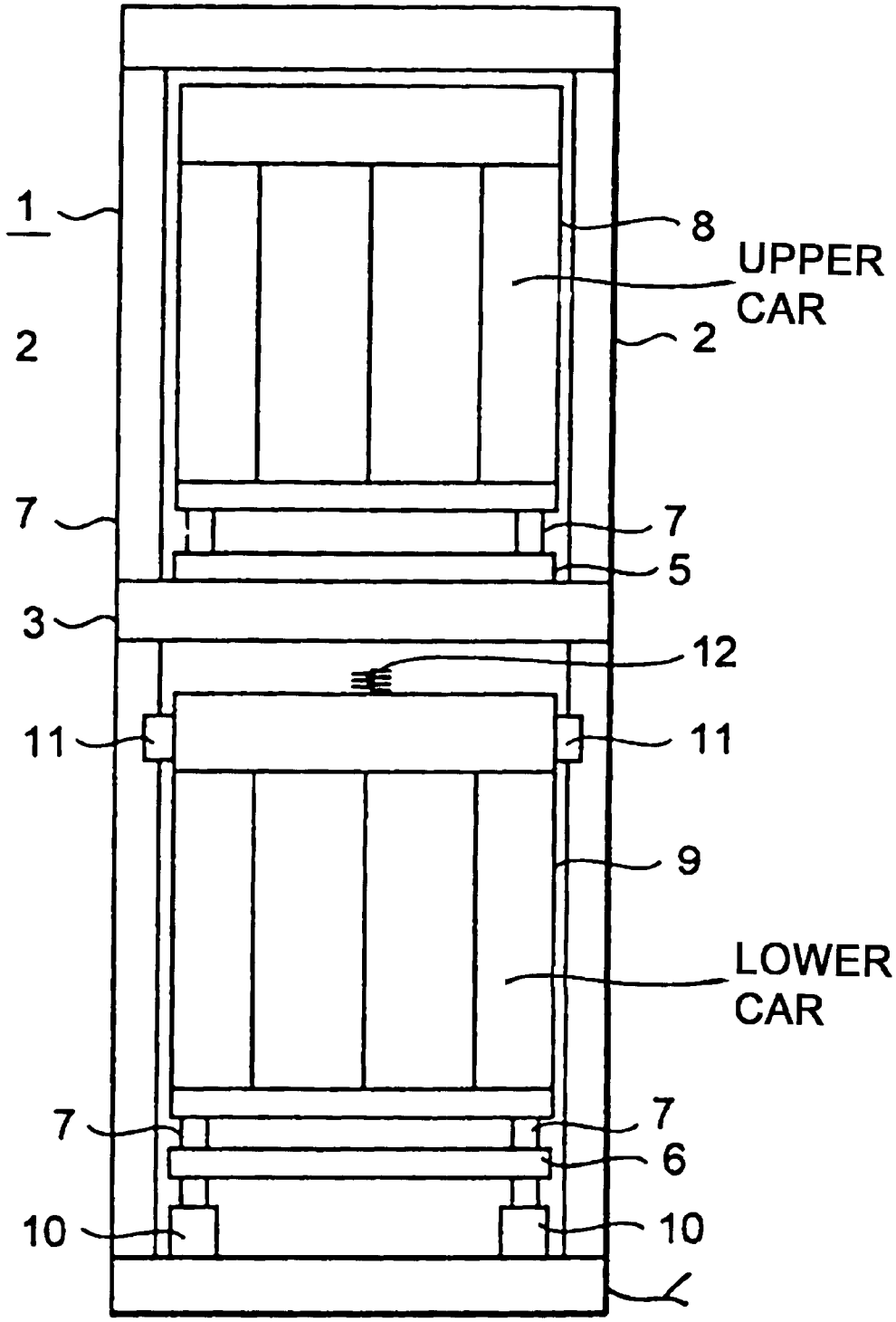
FIG. 8 PRIOR ART
FIG. 8 is a elevational view of a conventional double-deck elevator.
Figure 9:
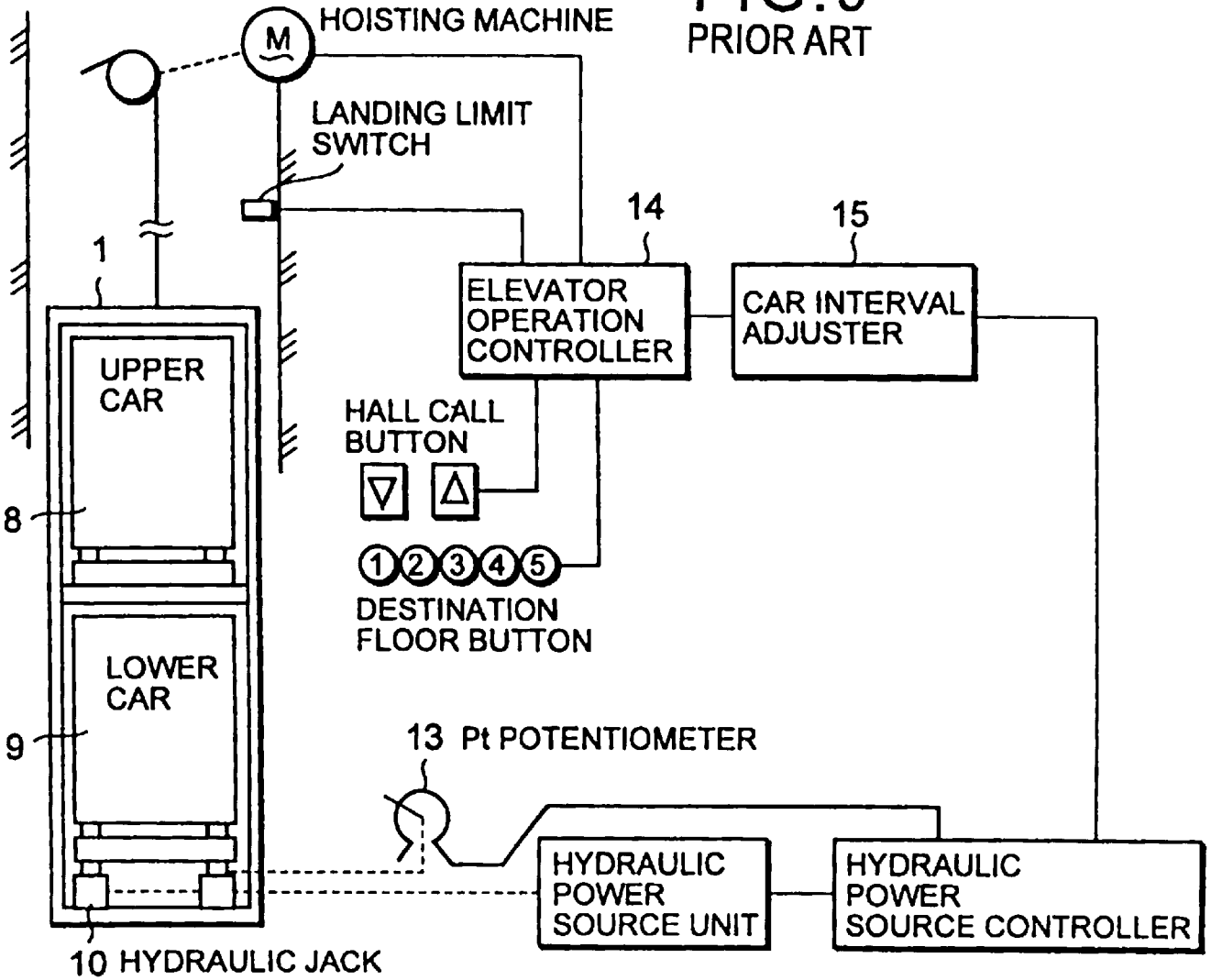
FIG. 9 PRIOR ART
FIG. 9 is a block diagram of the conventional double-deck elevator.
Figure 10:
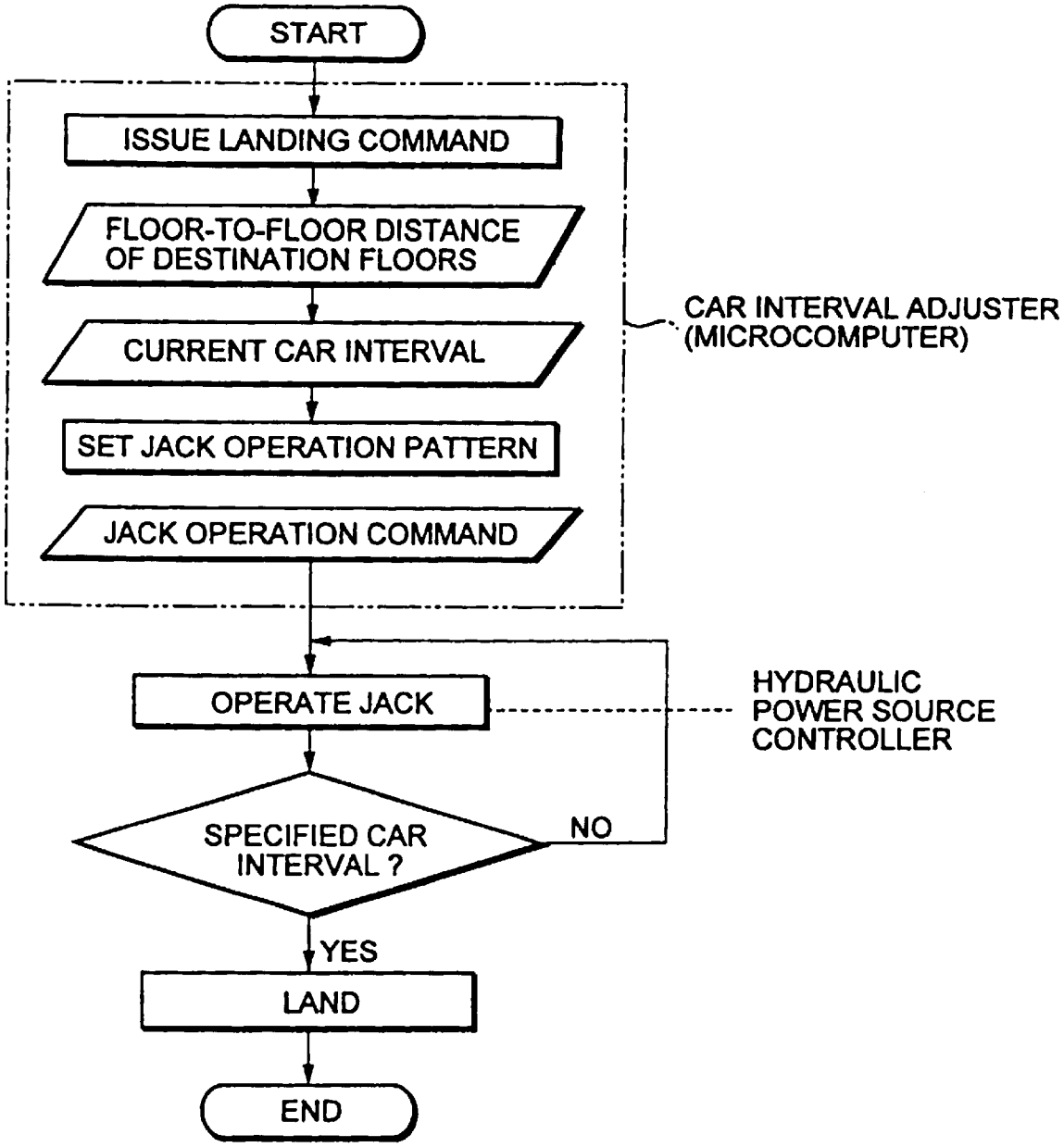
FIG.10 PRIOR ART
FIG. 10 is a flowchart of the conventional double-deck elevator.

FIG. 7 is a elevational view showing a structure of a double-deck elevator adapted to move the lower car 9 and the upper car 8 at an equal interval in opposite directions by an elevator mechanism in which a motor connected to a sheave is installed in a car frame, and two ends of a rope wound on the sheave are connected to individual cars.

FIGS. 4(*a*), 4(*b*), 4(*c*), and 4(*d*) show speed command value and acceleration curve charts for describing an operation of a speed command value generating unit 52 in a second embodiment.

Figure 5:
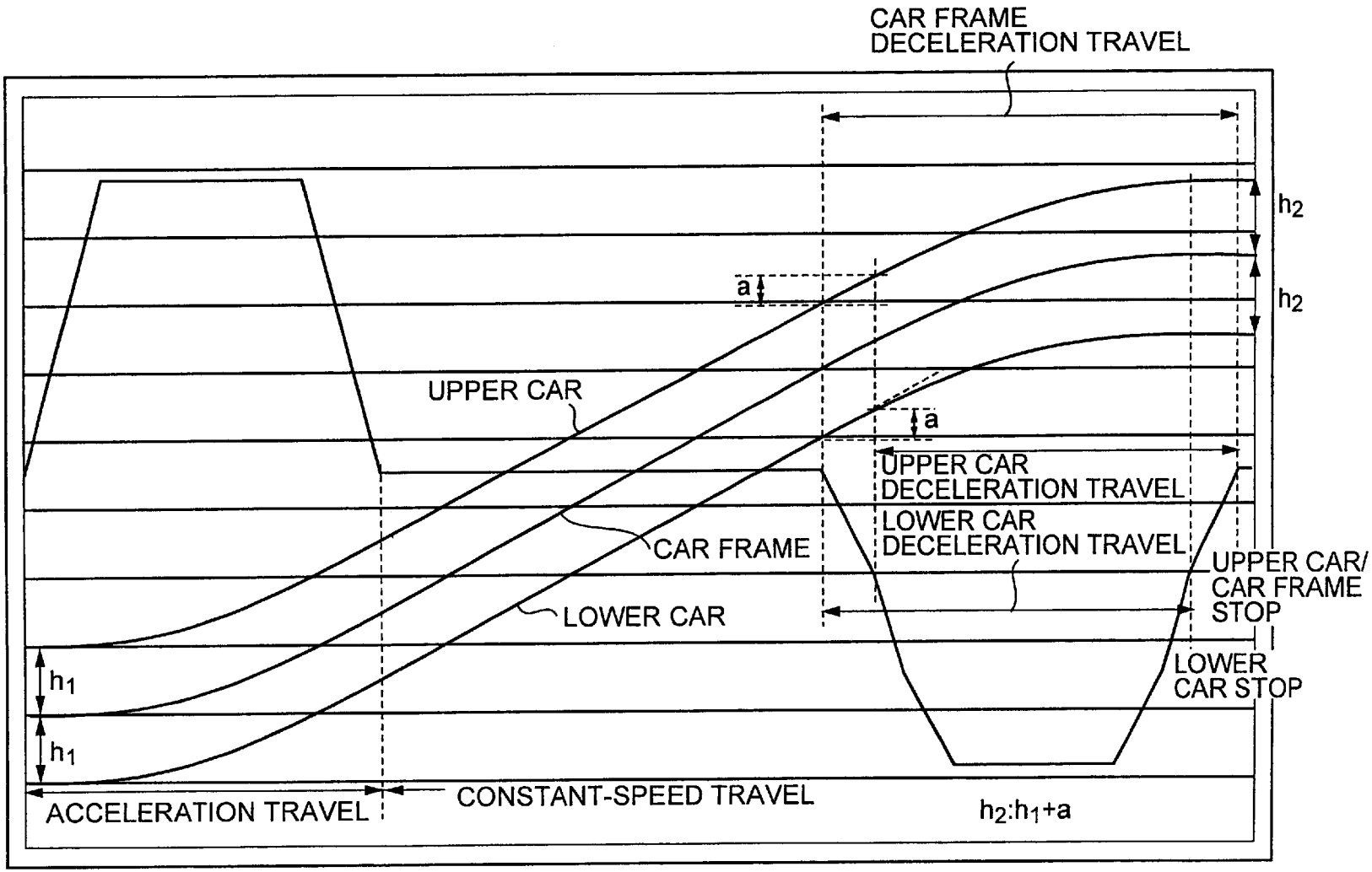
FIG. 5 is a schematic travel chart of a car frame and upper and lower cars for the second embodiment of the present invention.

FIG. 5 is a schematic travel chart showing time-dependent positions of a car frame 1, a lower car 9, and an upper car 8 in the second embodiment.

An operation will now be described.

The second embodiment performs the same operation as that of the first embodiment from a startup to a constant-speed travel.

A remaining distance computing unit 53 computes a travel distance required for each of the car frame 1, the lower car 9, and the upper car 8 to land planned floors, based on a floor-to-floor distance of respective floors stored beforehand in a floor-to-floor distance storage 54.

In a similar procedure to that disclosed in the foregoing publication, the speed command value generating unit 52 generates a lower car speed command value Vdl, an upper car speed command value Vdu, and a car frame speed command value Vdf that decrease at a predetermined deceleration according to a remaining distance based on the positions of the cars.

In the case of the mechanism shown in FIG. 6 and FIG. 7, the operations of the lower car 9 and the upper car 8 must be always performed at the same time. Hence, unlike the first embodiment, the deceleration start points cannot be set at different positions. In this case, therefore, the car frame speed command value Vdf is corrected based on the lower car speed command value Vdl and the upper car command value Vdu, then a lower car difference speed command value JVl and an upper car difference speed command value JVu are combined to accomplish coincidence with a predetermined deceleration waveform.

For instance, the car frame speed command value may be determined by Vdf=(Vdl+Vdu)/2, and the car frame 1 takes a complicated movement as indicated by the lines as clearly seen in the acceleration line chart of FIG. 4(*b*). However, the cars can be smoothly and accurately landed at individual destination floors without causing passengers in the lower car 9 and the upper car 8 to feel uncomfortable acceleration or deceleration.

Thus, the double-deck elevator control system in accordance with the present invention performs acceleration and deceleration in a regular travel pattern, and the acceleration and deceleration can be adjusted based on a floor-to-floor distance between destination floors. Hence, the present invention makes it possible to provide a double-deck elevator ideally suited for transporting passengers that is capable of providing a comfortable ride without causing passengers to feel uneasy due to uncomfortable acceleration or deceleration.

What is claimed is:

1. A double-deck elevator control system comprising:

a car frame retaining two elevator cars such that the two elevator cars may be vertically moved relative to the car frame;

a first control unit for controlling movement of the car frame;

an actuator for vertically moving the two elevator cars equal intervals in opposite directions with respect to the car frame;

a second control unit for controlling the actuator;

a remaining travel distance computing unit for computing remaining travel distances of the car frame and of the two elevator cars from current positions of each of the car frame and the two elevator cars, to planned stopping positions; and a speed command generating unit for generating a first speed command value based on travel distance of the car frame and outputting the first speed command value to the first control unit, and for generating a second speed command value based on the remaining travel distance of each of the elevator cars and outputting the second speed command value to the second control unit, wherein the first control unit controls movement of the car frame based on the first speed command value, the second control unit controls the actuator based on a difference between the first and second speed command values, and while the car frame and the two cars are decelerating, the first speed command value is calculated as a mean value of respective speed command values for the two cars.

2. The double-deck elevator control system according to claim 1, wherein the actuator has a pantograph mechanism.

3. The double-deck elevator control system according to claim 1, wherein the actuator has a suspension elevator mechanism.

4. A double-deck elevator control system comprising:

a car frame retaining two elevator cars such that at least one of the two elevator cars may be vertically moved relative to the car frame;

a first control unit for controlling movement of the car frame;

an actuator for vertically moving at least one of the two elevator cars with respect to the car frame;

a second control unit for controlling the actuator; and a remaining travel distance computing unit for computing remaining travel distances of the car frame and of the two elevator cars from current positions of each of the car frame and the two elevator cars, to planned stopping positions, of the car frame and the two elevator cars wherein the first control unit controls movement of the car frame based on the remaining travel distance of the car frame, the second control unit controls the actuator based on a difference between the remaining travel distance of the car frame and the remaining travel distances of each elevator car, and the second control unit prevents operation of the actuator during acceleration and constant speed movement of the car frame and controls the actuator to operate only after the car frame begins decelerating movement.

5. The double-deck elevator control system according to claim 4, further comprising a detector for detecting a relative position of each elevator car with respect to the car frame, and wherein the remaining travel distance of each elevator car is calculated based on the relative position of each elevator car with respect to the car frame.

6. The double-deck elevator control system according to claim 4, wherein the actuator includes two lifting units for vertically moving the two elevator cars independently with respect to the car frame.

7. The double-deck elevator control system according to claim 4, wherein a first car of the two elevator cars is secured to the car frame, and only a second car of the two elevator cars is vertically movable by the actuator.

8. A double-deck elevator control system comprising:

a car frame retaining two elevator cars such that at least one of the two elevator cars may be vertically moved relative to the car frame;

a first control unit for controlling movement of the car frame;

an actuator for vertically moving at least one of the two elevator cars with respect to the car frame;

a second control unit for controlling the actuator;

a remaining travel distance computing unit for computing remaining travel distances of the car frame and of the two elevator cars from current positions of each of the car frame and the two elevator cars, to planned stopping positions; and a speed command generating unit for generating a first speed command value based on travel distance of the car frame and outputting the first speed command value to the first control unit, and for generating a second speed command value based on the remaining travel distance of each elevator car and outputting the second speed command value to the second control unit, wherein the first control unit controls movement of the car frame based on the first speed command value, the second control unit controls the actuator based on a difference between the first and second speed command values, and the second control unit prevents operation of the actuator during acceleration and constant speed movement of the car frame and controls the actuator to operate only after the car frame begins decelerating movement.

9. The double-deck elevator control system according to claim 8, wherein the actuator includes two lifting units for vertically moving the two elevator cars independently with respect to the car frame.

10. The double-deck elevator control system according to claim 8, wherein a first car of the two elevator cars is secured to the car frame, and only a second car of the two elevator cars is vertically movable by the actuator.

11. A double-deck elevator installed in a building having non-uniform distances between pairs of floors and including a car frame retaining two elevator cars such that at least one of the two elevator cars may be vertically moved relative to the car frame, wherein the two cars travel at the same deceleration and stop at individual destination floors by changing a deceleration start point of the car based upon the distance between the individual destination floors.

* * * * *